US005507589A

United States Patent [19]

Jacobs

[11] Patent Number: 5,507,589

[45] Date of Patent: Apr. 16, 1996

[54] DELINEATOR POLE

[75] Inventor: John F. Jacobs, Salt Lake City, Utah

[73] Assignee: Reliable Racing Supply, Inc., N.Y.

[21] Appl. No.: 300,233

[22] Filed: Sep. 7, 1994

Related U.S. Application Data

[63] Continuation of Ser. No. 180,788, Jan. 7, 1994, abandoned, which is a continuation of Ser. No. 878,485, May 4, 1992, abandoned.

[51] Int. Cl.[6] ..... E01F 9/00

[52] U.S. Cl. ..... 404/11; 40/598

[58] Field of Search ..... 404/9–11; 40/598, 40/608–610; 52/103, 153, 165; 116/63 R, 173, 209; 248/530–532

[56] References Cited

U.S. PATENT DOCUMENTS

| | | | |
|---|---|---|---|
| 1,337,947 | 4/1920 | O'Toole | 404/10 X |
| 1,726,817 | 9/1929 | Franklin | 404/10 X |
| 3,279,133 | 10/1966 | Korte | 404/10 X |
| 3,371,647 | 7/1966 | Shopbell . | |
| 3,378,863 | 1/1967 | Johnson . | |
| 3,416,484 | 12/1968 | Chapman | 404/10 X |
| 3,623,286 | 9/1969 | Parduhn | 404/10 X |
| 4,161,723 | 7/1979 | De Vittori . | |
| 4,270,873 | 6/1981 | Laehy et al. . | |
| 4,522,530 | 6/1985 | Arthur | 404/10 |
| 4,588,324 | 5/1986 | Goellner . | |
| 4,599,012 | 7/1986 | Kugler et al. . | |
| 5,024,551 | 6/1991 | Hinterholzer . | |
| 5,054,955 | 10/1991 | Habernig . | |
| 5,090,348 | 2/1992 | Hugron | 404/10 X |

FOREIGN PATENT DOCUMENTS

| | | |
|---|---|---|
| 2939111 | 5/1980 | Germany . |
| 3244858A1 | 6/1984 | Germany . |
| 1-239209 | 9/1989 | Japan . |

*Primary Examiner*—Stephen C. Pellegrino
*Assistant Examiner*—Nancy Mulcare
*Attorney, Agent, or Firm*—Ronald P. Kananen

[57] ABSTRACT

A fixed or self-redressing delineator pole comprising a lower portion for insertion into a support structure and an upper portion which serves as a marker such as for a slalom gate, a parking lot, a field, or a road. The delineator pole uses an impact absorbing material over a rigid or semi-rigid inner tube to create a cushioned extended surface which absorbs impact. Ski racing, for example, involves full contact between skiers travelling at high rates of speed and the slalom poles resulting in numerous injuries to the skier and damage to the pole. This delineator pole reduces injury to the pole and other objects resulting from objects colliding with the pole.

20 Claims, 2 Drawing Sheets

DELINEATOR POLE

This application is a continuation, of application Ser. No. 08/180,788 filed Jan. 7, 1994, abandoned, which is a continuation of application Ser. No. 07/878,485 filed May 4, 1992 (now abandoned).

FIELD OF THE INVENTION

This invention relates to a delineator pole, fixed or self-redressing, for use in marking boundaries, such as a pole used as part of a slalom gate and more particularly to a delineator pole which softens the impact of an object colliding with the pole.

BACKGROUND OF THE INVENTION

Many different types of delineator poles, used for such things as slalom gates, hazard markers, parking lot boundary markers, sign posts, or field markers, are known in the prior art.

Delineating poles are often damaged or cause damage when a moving object comes into contact with the pole. Ski racing, for example, involves full contact between skiers travelling at high rates of speed and the slalom poles resulting in numerous contusions and facial injuries to the skier. Parking lot boundary marking poles, for example, are often struck by vehicles causing damage to both the pole and the vehicle.

Typical slalom poles are shown in U.S. Pat. Nos. 5,054,955; and 4,588,324 and a typical self-redressing slalom pole is shown in U.S. Pat. No. 4,599,012. A typical field marker is shown in U.S. Pat. No. 3,371,647, and a typical delineator pole is shown in U.S. Pat. No. 4,270,873.

None of these prior art delineator poles, however, sufficiently reduces the impact resulting from a collision between the pole and a moving object such that injury to the pole and object is reduced, or minimized.

Thus, it is a problem in the prior art to reduce the damage to both a person or object and the delineator pole resulting when a moving object collides with the delineator pole.

It is also a problem in the prior art to provide a delineator pole which not only softens the impact of a person or object colliding with it, but is also able to restore itself to an upright position after the collision.

SUMMARY OF THE INVENTION

It is an object of the present invention to provide a delineating pole which softens the impact of a moving object, such as a skier, colliding with the delineator pole.

It is a further object of the present invention to extend the integrity and longevity of the delineating pole.

It is a further object of the present invention to provide a delineator pole which can restore itself to an upright position after being struck by an object.

Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects, in accordance with the present invention, as embodied and broadly described herein, the delineator pole of this invention may comprise a pole having a lower portion held in position by a support structure and an upper portion serving as a marker and wherein the pole is comprised of an inner rigid or semi-rigid tube formed from a first material extending from the lower portion of the pole to the upper portion of the pole, and a layer of impact absorbing material attached to and surrounding the inner tube to reduce the impact resulting from a collision between a moving object and the pole. The layer of impact absorbing material may itself comprise the outer layer of the pole of the invention, or it may be covered by an additional aesthetically pleasing and durable outer layer. In either case, advertising indicia may be applied to the outer layer.

BRIEF DESCRIPTION OF THE DRAWINGS

The accompanying drawings, which are incorporated in, and form a part of, the specification, illustrate an embodiment of the present invention and, together with the description, serve to explain the principles of the invention.

In the drawings.

DETAILED DESCRIPTION OF THE PREFERRED EMBODIMENT

Reference will now be made in detail to the preferred embodiment of the invention, an example of which is illustrated in the accompanying drawings.

Illustrated in FIGS. 1, 2, 3 and 4 is the delineator pole of the present invention. The delineator pole is indicated generally at 10. The delineator pole 10 has a lower portion 12 for insertion into the ground as shown at 11 in FIG. 1 or other support surface as shown at 30 in FIG. 4 and an upper portion 14 extending upwardly from the ground or support surface acting as a marker. While the lower portion 12 is shown having a conical shape, it is recognized it could be of any shape which would facilitate its insertion into the ground or other support surfaces.

Figure 1:
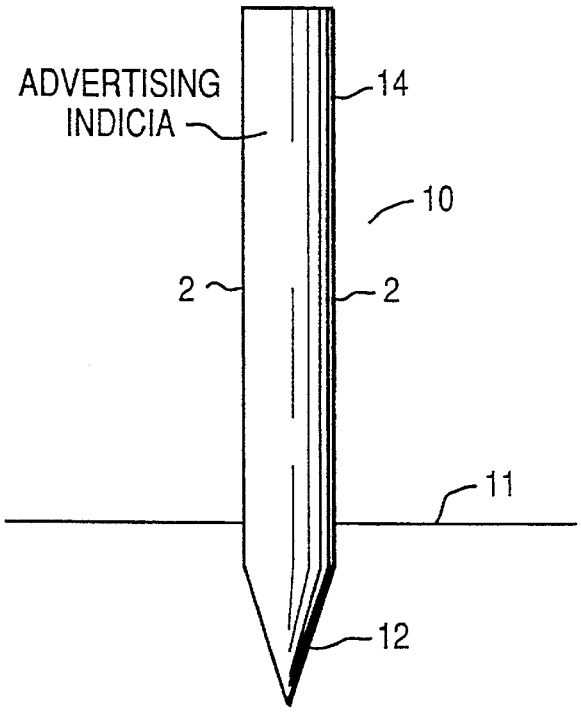
FIG. 1 is a view of the delineator pole of the present invention.
Figure 2:
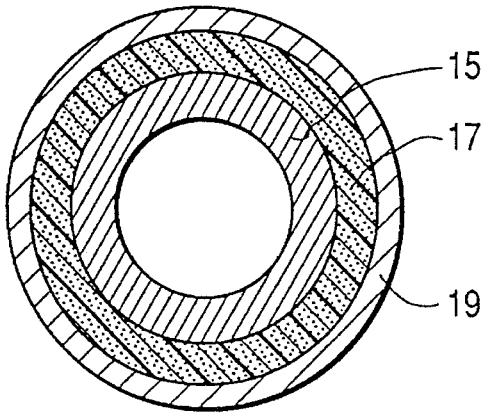
FIG. 2 is a cross-sectional view taken along lines 2—2 of FIG. 1.
Figure 4:
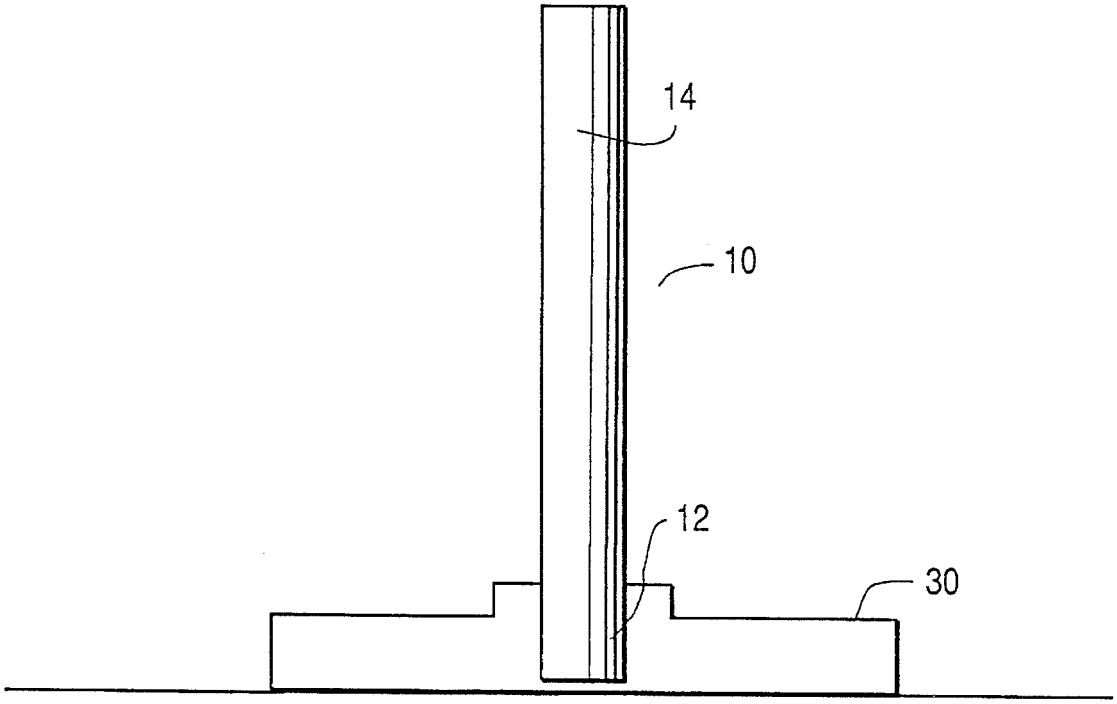
FIG. 4 is a view of the delineator pole of the present invention in a support structure.

FIG. 2 shows the cross-section of the delineator pole of FIG. 1. As shown in FIG. 2, the delineator pole 10 is comprised of an inner rigid or semi-rigid tube 15. This inner tube 15 may be made out of natural or synthetic materials, including fiberglass, composites, thermoplastics, metals, wood, bamboo, or rubber. A layer of cushioning material 17 surrounds the rigid or semi-rigid tube 15 to soften the impact of a moving object colliding with the pole 10. Layer 17 may be made out of natural or synthetic foam or other soft, impact-absorbent material. The resilience of the cushioning material is selected in accordance with the end use of the pole and the skill in the art. For example, a ski pole is used in cold temperatures, so the cushioning material will be resilient at these temperatures.

An optional outer layer 19 can be placed over layer 17. The outer layer 19 serves many purposes. The outer layer 19 can serve to protect the layer 17 and thereby extend the life of the layer 17. The outer layer 19 can also provide any desired finishing texture. In addition, using an outer skin 19 provides graphic opportunities, i.e. colors, designs, logos, sponsors, or other indicia may be added to the pole. The outer skin 19 may be made out of a fabric, such as nylon, mylar or vinyl or a plastic sheet.

The cushioning layer 17 can be attached to the inner tube 15 by any known fastening means. Preferably, such means include fasteners, adhesives, velcro, heat welding, co-extrusion, or through integration of the outer skin. In addition, the outer layer 19 can be attached to the cushioning layer by any known means such as a glue fastener.

The inner rigid or semi-rigid tube 15 provides pole 10 with the rigidity and reenforcement necessary for the pole to remain upright, while the cushioning layer 17 softens the impact of a moving object, such as a skier, bicycle, automobile, snowboarder, rollerblader, etc., when colliding with the delineator pole.

Figure 3:
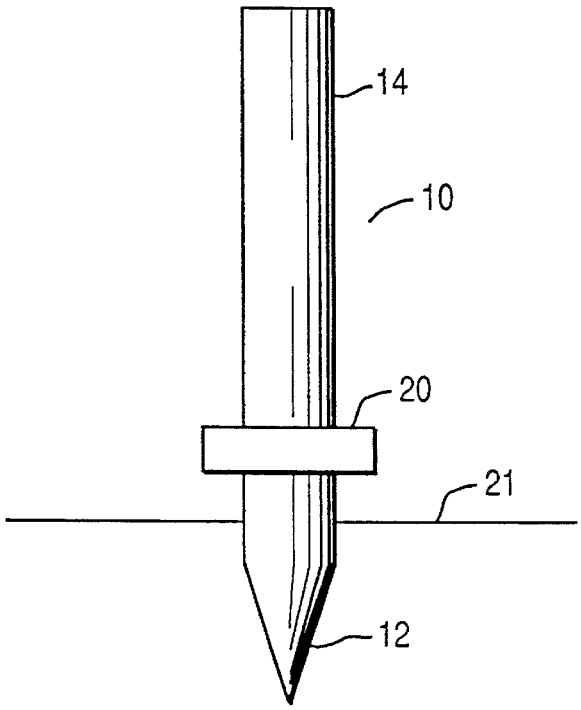
FIG. 3 is a view of a self-redressing delineator pole of the present invention.

The delineator pole of the present invention can be fixed or self-redressing. FIG. 3 shows a self-redressing delineator pole as described in relation to FIGS. 1, 2 and 4, also including a hinge 20. When it is desired, such as in ski racing, for the pole to return to the upright position, the inner tube 15 and cushioning layer 17 provide sufficient flexibility and strength such that the delineator pole can re-right itself about the hinge 20.

Many benefits and advantages result from the novel combination of a rigid inner tube with a cushioning outer layer. Because of the resiliency and the impact absorbing nature of the cushioning layer, damage to both the pole and the object is reduced and the integrity and longevity of the pole is increased. In addition, the need for protective gear, such as arm and leg pads, bumpers and head gear, is reduced.

The use of an outer layer also allows for graphic opportunities. The pole can easily and inexpensively be made a certain color, or covered with a certain logo or sponsor. In addition, the color, logo or sponsor can be easily and inexpensively changed or replaced.

The foregoing description of a preferred embodiment of the invention has been presented for purposes of illustration and description. It is not intended to be exhaustive or to limit the invention to the precise form disclosed. Many modifications and variations are possible in light of the above teaching. The embodiment was chosen and described in order to best explain the principles of the invention and its practical application to thereby enable others skilled in the art to best utilize the invention and various embodiments and with various modifications as are suited to the particular use contemplated. It is intended that the scope of the invention only be limited by the claims appended hereto.

We claim:

1. An elongate relatively small diameter delineator pole for use on a ski slope comprising:

a lower portion which is shaped for piercing insertion into said slope and an upper portion serving as a marker, said upper portion comprising:

a hollow tube which is formed from a first material and which extends upwardly from the lower portion of the pole to an upper end of the pole, said hollow tube being formed of a material which is at least semi-rigid, said first material being selected from the group consisting of fiberglass, composites, thermoplastics, metals, wood, bamboo and rubber;

a first layer formed from an impact absorbing foam material which remains resilient at zero to sub-zero freezing temperatures, said first layer being attached to and surrounding said hollow tube to reduce impact resulting from a collision between a skier and the pole; and an optional outer layer formed from a third material which is attached to and surrounds said first layer to cover and protect said pole.

2. A delineator pole as claimed in claim 1, wherein said impact absorbing material is a natural or synthetic foam.

3. A delineator pole as claimed in claim 1, wherein said third material is a fabric or plastic sheet.

4. A delineator pole as claimed in claim 3, wherein said fabric is a material selected from the group consisting of nylon, mylar, vinyl, and mixtures thereof.

5. A self-redressing delineator pole for use on a ski slope comprising: a lower portion held in position by a support structure, and an elongate small diameter upper portion of sufficient length to serve as a ski course marker, said upper portion comprising:

a tube which is formed from a first material and which extends upwardly from the lower portion of the pole to an upper end of the pole, said tube being formed of a material which is at least semi-rigid, said first material being selected from the group consisting of fiberglass, composites, thermoplastics, metals, wood, bamboo and rubber; and a first layer formed from an impact absorbing foam material which remains resilient in a temperature range including zero to sub-zero freezing temperatures, said first layer being attached to and surrounding said tube to reduce impact resulting from a collision between a skier and the pole, said tube and said first layer defining means which endows sufficient strength and flexibility on said upper portion such that said upper portion can re-right itself and return to an upright position after contact with a skier.

6. A delineator pole as claimed in claim 5, further comprising an outer layer formed from a third material attached to and surrounding said first layer to protect and cover said pole.

7. A delineator pole as claimed in claim 6, further comprising a hinge at the boundary of said lower portion and said upper portion, whereby said pole can re-right itself about said hinge.

8. A delineator pole as claimed in claim 5, wherein said impact absorbing foam material is natural or synthetic foam.

9. A delineator pole as claimed in claim 6, wherein said third material is a fabric or plastic sheet.

10. A delineator pole as claimed in claim 9, wherein said fabric is a material selected from the group consisting of nylon, mylar, vinyl, and mixtures thereof.

11. A delineator pole as claimed in claim 5, wherein said support structure comprises an end portion of said lower portion which is shaped and dimensioned for piercing insertion into said slope and which further comprises a hinge located between said upper portion and said lower portion, said hinge facilitating tilting and subsequent self-redressing of said pole in response to a collision.

12. A delineator pole as claimed in claim 5, wherein said support structure comprises a flat bottomed base member which sits on the surface of said slope and which further comprises a hinge located between said upper portion and said lower portion, said hinge facilitating tilting and subsequent self-redressing of said pole in response to a collision.

13. A delineator pole as claimed in claim 5, wherein said support structure comprises a flat bottomed base member which sits on the surface of said slope.

14. A self-redressing slalom gate pole for use on a ski slope comprising:

a lower portion held in position by a support structure, and an upper elongate small diameter portion serving as a ski course marker, said upper portion comprising:

a tube formed from a first material extending upwardly from the lower portion of the pole to an upper end of the pole, said tube being formed of a first material which is at least a semi-rigid, said first material being selected from the group consisting of fiberglass, composites, thermoplastics, metals, wood, bamboo and rubber;

a first layer formed from a second impact absorbing foam material attached to and surrounding said tube to reduce the impact resulting from a collision between a moving skier and the pole;

an outer layer formed from a third material attached to and surrounding said first layer to protect and cover said pole; and a hinge at the boundary of said lower portion and said upper portion, said tube and said first layer providing sufficient strength and flexibility such that, in combination with said hinge, said pole can tilt and subsequently re-right itself about said hinge and return to an upright position after contact with a skier.

15. A delineator pole as claimed in claim 14, wherein said first material is a material selected from the group consisting of fiberglass, composites, thermoplastics, metals, wood, and rubber.

16. A delineator pole as claimed in claim 13, wherein said impact absorbing foam material is natural or synthetic foam.

17. A delineator pole as claimed in claim 14, wherein said third material is a fabric or plastic sheet.

18. A delineator pole as claimed in claim 17, wherein said fabric is a material selected from the group consisting of nylon, mylar, vinyl, and mixtures thereof.

19. A delineator pole as claimed in claim 14, wherein indicia may be applied to said outer layer.

20. A delineator pole as claimed in claim 14, wherein said support structure comprises an end portion of said lower portion which is shaped and dimensioned for piercing insertion into said slope.

* * * * *